United States Patent [19]

Lancia et al.

[11] 4,241,847

[45] Dec. 30, 1980

[54] ICE CREAM CONE AUTOMATIC VENDING MACHINE

[76] Inventors: Frederick N. Lancia; William A. Wolfe; Leonard F. Dearth; Stephen L. Benton; H. Richard Homan; Arthur P. Bruce, all of 1050 Dearborn Dr., Columbus, Ohio 43229

[21] Appl. No.: 891,315

[22] Filed: Mar. 29, 1978

[51] Int. Cl.[2] ..... G07F 11/54; G07F 11/10

[52] U.S. Cl. ..... 221/12; 221/96; 221/312 R

[58] Field of Search ..... 221/12, 96, 113, 220, 221/312 R; 141/174; 312/291

[56] References Cited

U.S. PATENT DOCUMENTS

| | | | |
|---|---|---|---|
| 2,591,507 | 4/1952 | Brous | 221/96 X |
| 2,621,838 | 12/1952 | Price | 141/174 X |
| 2,915,219 | 12/1959 | Salerno | 221/236 X |
| 2,967,644 | 1/1961 | Barber et al. | 141/174 X |
| 3,413,052 | 11/1968 | Schoenmakers | 221/220 X |
| 4,136,800 | 1/1979 | Christner et al. | 221/1 |

*Primary Examiner*—F. J. Bartuska

[57] ABSTRACT

An automatic vending machine for delivering stackable containers having edible product therein. A container discharge station—especially for cones—is provided with at least one stack of containers disposed in a position vertically above an arm for clampingly engaging the containers and movement of the containers below a product dispensing nozzle and into a delivery chamber. The cones are dropped one at a time from the one or more stacks through an opening in a plate into operative engagement with the arm. A guide structure is located vertically between the at least one container stack and the arm, guiding the dropping of the containers into association with the arm so that the containers will not be misaligned or inverted during dropping and will be positively guided into operative association with the arm. The guide structure includes a generally tubular member disposed below the plate and a chute disposed vertically below the tubular member and having a primary container-guiding portion thereof extending downwardly from the tubular member at an obtuse angle with respect to the vertical.

3 Claims, 10 Drawing Figures

11
13
10
124
14
77
12

61
55
D
63
54

Fig. 8
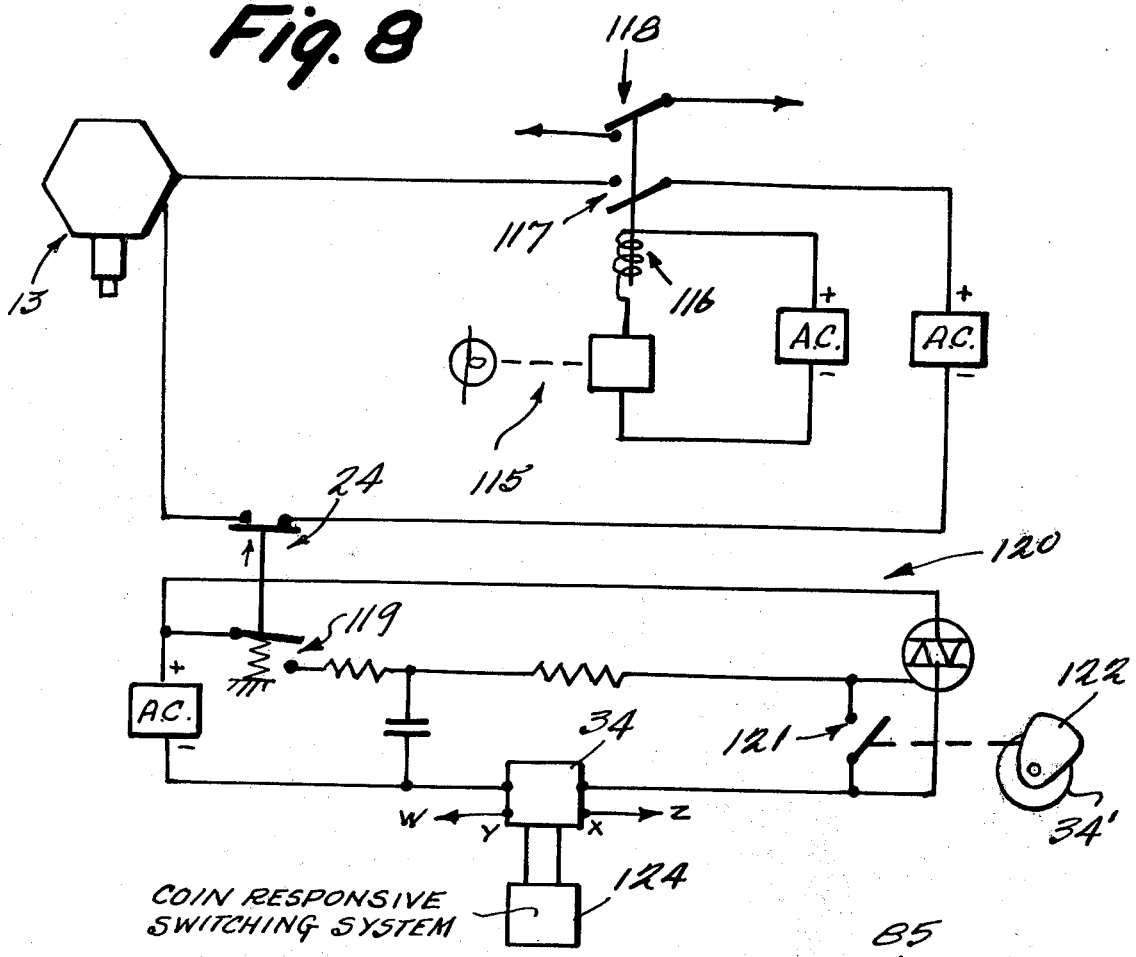
Fig. 9
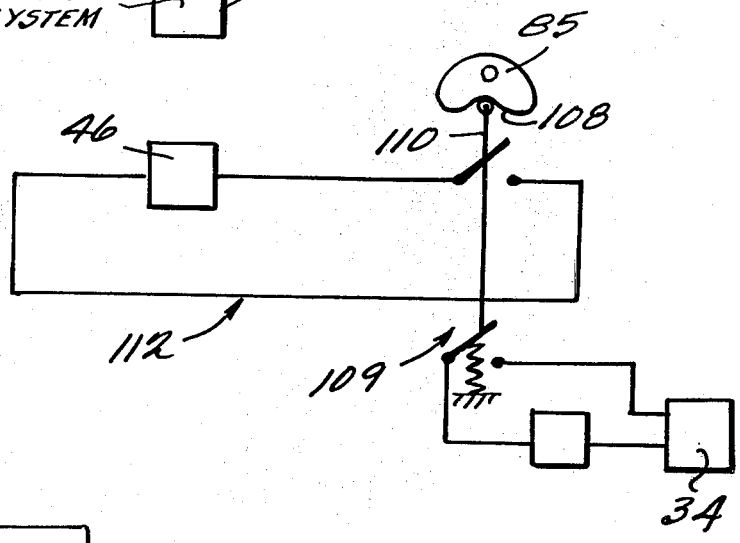
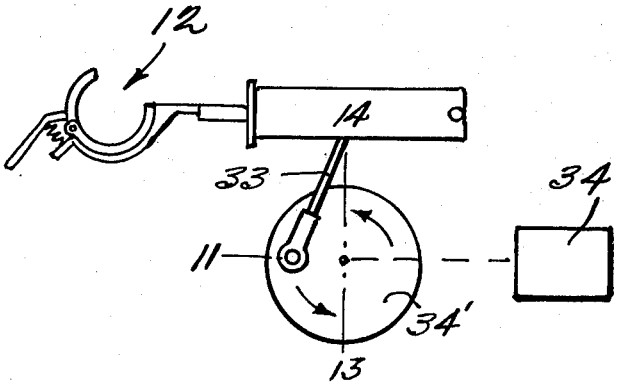
Fig. 10

ICE CREAM CONE AUTOMATIC VENDING MACHINE

BACKGROUND AND SUMMARY OF THE INVENTION

U.S. Pat. No. 3,413,052 discloses a system that, for the first time, provides for practical automatic vending of ice cream cones and the like. While the system shown in U.S. Pat. No. 3,413,052 is practical, there are certain problems associated therewith. One problem is the tendency for the cones or other containers to be misaligned or to become inverted during dropping of the cones from a stack into operative association with the delivery arm.

According to the present invention, the problem of cone misalignment or inversion that is inherent in the prior art has been eliminated by providing a simple, inexpensive cone guiding means located vertically between the stack of containers and the arm for guiding dropping of the containers into operative association with the arm so that the containers will not be misaligned or inverted during dropping and will be positively guided into operative association with the arm. The guide means generally includes a tubular member disposed below the stack and having the bottom end thereof disposed directly above a chute. The chute has a generally open top and has a primary container-guiding portion thereof extending downwardly from the tubular member and disposed at an obtuse angle with respect to the axis of the tubular member. The generally tubular member may have angled wall portions thereof formed on the side of the member axis from which the chute extends downwardly at the obtuse angle in order to insure that the tubular member will not interfere with the dropping movement of the cone once it engages the chute.

The chute container-guiding portion is preferably semi-circular in cross-section, having a diameter slightly greater than the greatest diameter of a container guided thereby. The clamping end of the container engaging arm is disposed below the chute as a continuation of the primary container-guiding surface thereof.

It is the primary object of the present invention to provide an improved machine for the automatic vending of ice cream cones or the like. This and other objects of the invention will become clear from an inspection of the detailed description of the invention and from the appended claims.

BRIEF DESCRIPTION OF THE DRAWINGS

FIG. 8 is a schematic electrical control assembly for control of an automatic vending machine according to the invention;

FIG. 9 is an electrical schematic showing circuitry means for control of the cone dispensing drive of FIG. 6; and FIG. 10 is a schematic showing of the operation or movement of the cone holding arm during operation of the machine according to the invention.

DETAILED DESCRIPTION OF THE INVENTION

Figure 1:
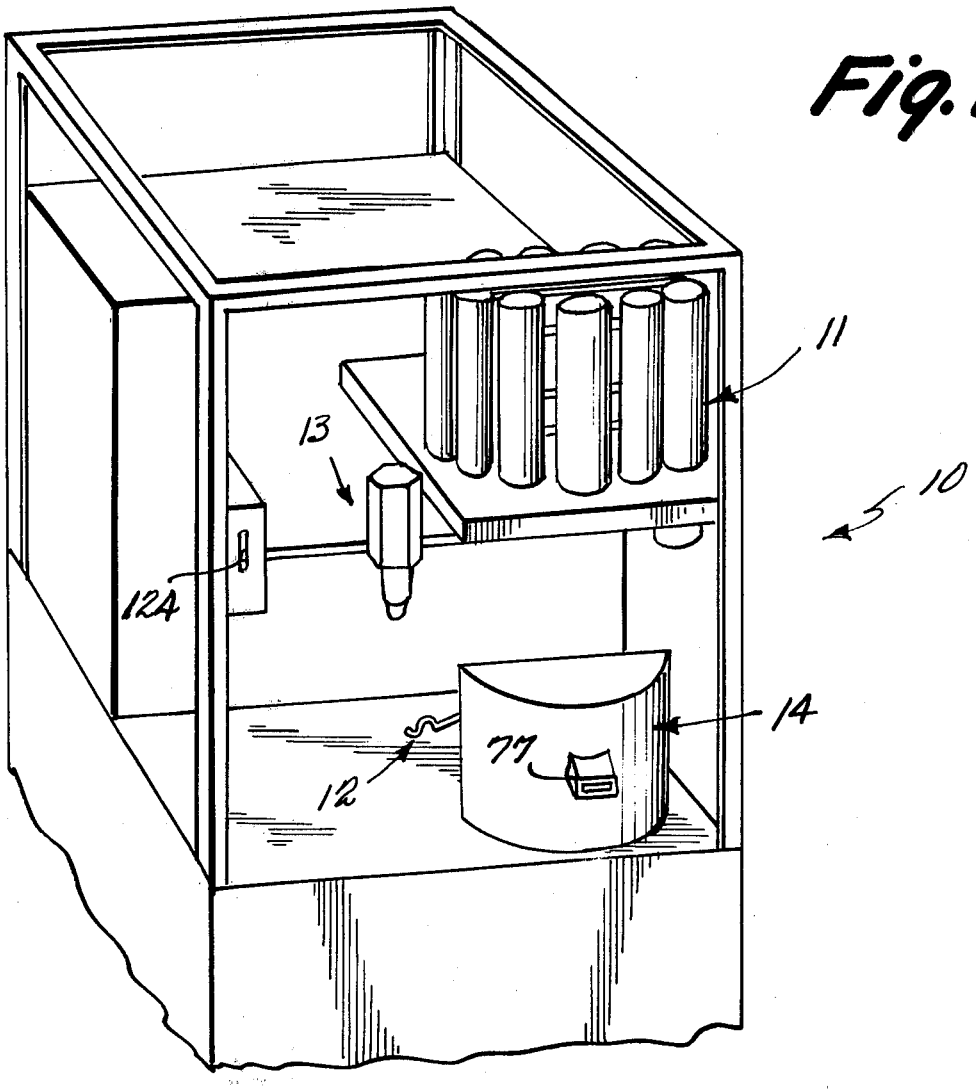
FIG. 1 is a schematic perspective view of an exemplary automatic venting machine according to the invention.
Figure 4:
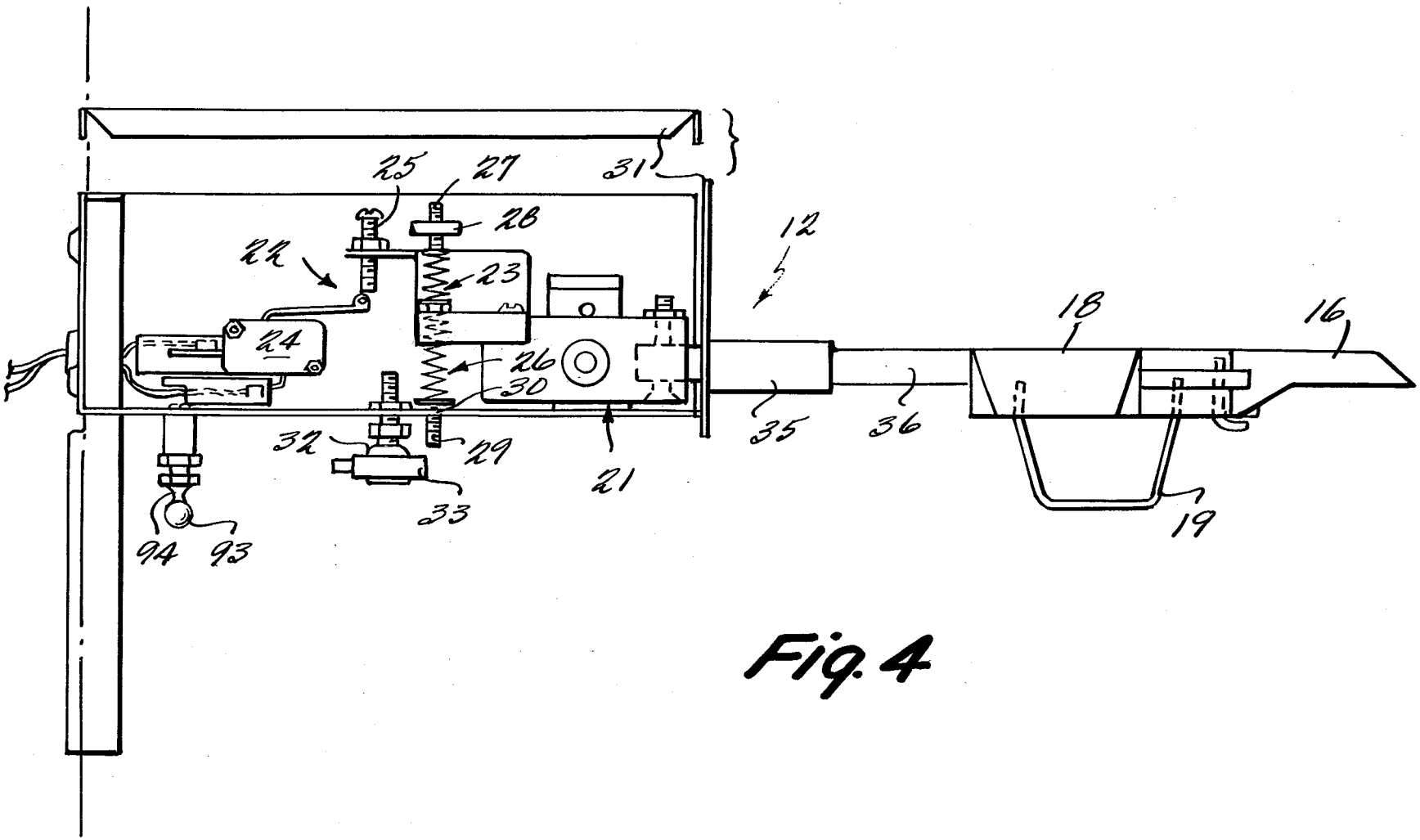
FIG. 4 is a side view, with portions cut away for clarity, of the container holding arm of FIG. 2.

An automatic vending machine for delivering containers (i.e., edible cones) having edible product therein, (i.e., soft ice cream, frozen yogurt) is shown schematically at 10 in FIG. 1. The machine includes a container discharge station 11 for discharging containers one at a time into operative association with an arm 12 pivotally mounted to the machine 10 for rotation about a first, generally vertical axis A—A (FIG. 4). The machine 10 also includes a container filling station 13 at which edible products is dispensed from a dispensing nozzle into the container automatically. The machine 10 also includes a delivery chamber 14 for receiving each product-filled container being vended, the consumer having access to the delivery chamber after the container filled with edible product is disposed within the chamber 14, and the arm 12 is removed from the chamber 14.

Figure 2:
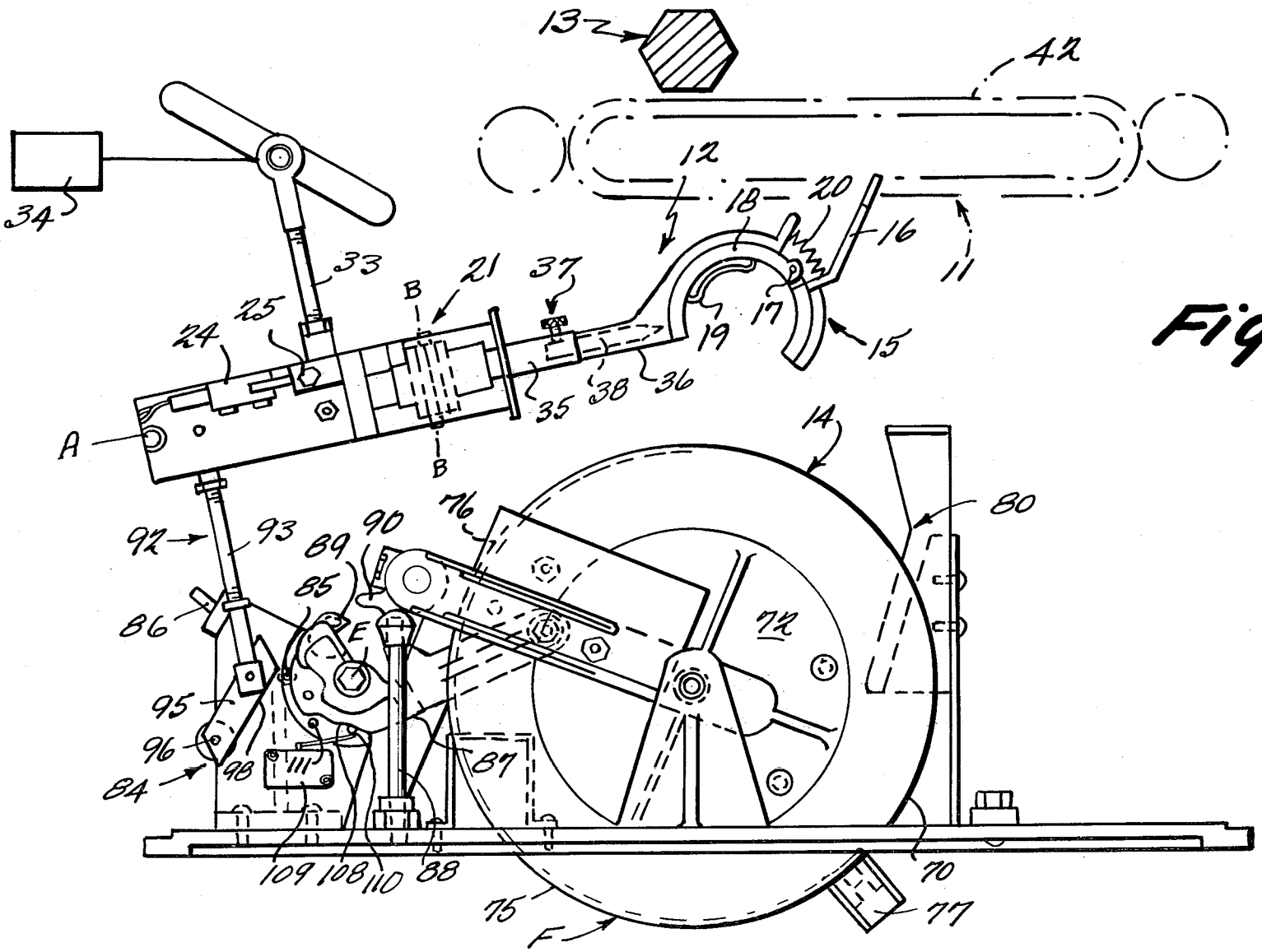
FIG. 2 is a top plan view showing a container holding arm, delivery chamber, and latching means.

As shown most clearly in FIGS. 2 and 4, the arm 12 has one end thereof having container-holding means 15 for receiving and holding containers adapted to have edible product delivered thereto, the means 15 including spring biased releasable clamping means including lever means 16 movable between first and second positions for alternatively clamping and griping a container therein. The clamping means 15 has an open top so that containers may be fed into operative association therewith from a position vertically above the means 15 without necessity of moving the lever means 16 against the spring bias. The lever means 16 is pivotally mounted at 17 to a main curved body portion 18 of the arm 12, the body portion 18 having a wire cone rest 19 associated therewith. A coil spring 20 or the like provides the bias for spring biasing lever means 16 so that the means 15 is normally in a position clampingly engaging a container.

The arm 12 also comprises means 21 for pivotally mounting the arm for rotation about a second, generally horizontal axis B—B, the means 21 including a collar and rod arrangement (See FIG. 4). Product weight responsive means 22 are also associated with the arm 12 for terminating delivery of product to a container at the container filling station 13 after a predetermined weight of product has been delivered to the container. The means 22 includes an adjustable first spring means 23 and in engagement with the arm 12 for biasing the arm container-holding means 15 and in an upward direction about the second pivot B—B. The means 22 also includes a microswitch 24, and microswitch actuating means 25 mounted to the arm 12 and movable against the bias of the first spring means 23 in response to product weight to actuate the microswitch 24. The position of the actuating means 25 relative to the arm 12 may be adjusted, as by providing the means 25 as a screw engageable a nut operatively connected to the arm 12.

The edible product dispensed according to the present invention normally is pressurized during dispensing—i.e., soft ice cream or machine-dispensed milk shakes and the like. In order to negate the effects of the delivery pressure on the weight-response of the weight responsive means 22, second adjustable spring means 26 are provided for biasing the arm 12 for rotation about the second pivot B—B in a direction opposite the direction in which the first spring 23 biases the arm 12. The first and second spring means 23, 26 may comprise coil springs mounted to screw rods 27, 29 respectively which are respectively engageable with interiorly threaded nuts 28, 30 to provide adjustment of the force exerted by the coil springs.

The spring means 23, 26 and the weight-responsive means 22, and the means 21 for pivotally mounting the arm 12 preferably are contained within a single housing 31, with a telescoping portion 35 of arm 12 extending horizontally outwardly from the housing 31, and the housing 31 mounted for pivotally movement about axis A—A. A ball joint 32 extends downwardly from the casing 31, and a lever 33 is mounted pivotally thereto, the lever 33 operatively connected to a motorized power source for oscillation of the arm 12 about the axis A—A (see FIGS. 2 and 10). The connection between lever 33 and power source 34 may be any suitable connection such as shown in U.S. Pat. No. 3,413,052, and as shown in FIG. 10.

If desired, adjustment of the length of the arm 12 may be provided by utilizing telescoping rod sections 35, 36 to make up the arm exterior of the housing 31. An adjustment 37 may be provided which bears on a flaten portion of a pin 38 extending between the telescoping members 36, 35 to provide for adjustment of the effective lengths of the sections 35, 36. Any other suitable length adjusting means may also be utilized.

By utilizing the arm 12 with spring biasing and product weight-responsive means according to the present invention, product such as soft ice cream or the like may be readily dispensed accurately. Without utilization of product-weighting means, difficulties can some time result in the dispensing of the product since the density of the product can change significantly, and because of other particulars of the makeup thereof. Utilizing the structure shown in FIGS. 2 and 4, however, accurate dispensing of the product is possible.

Figure 7:
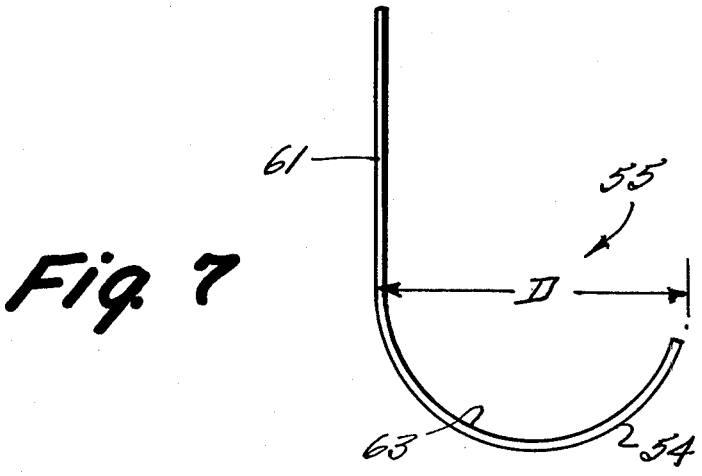
FIG. 7 is an end view of the cone chute of FIG. 6.
Figure 5:
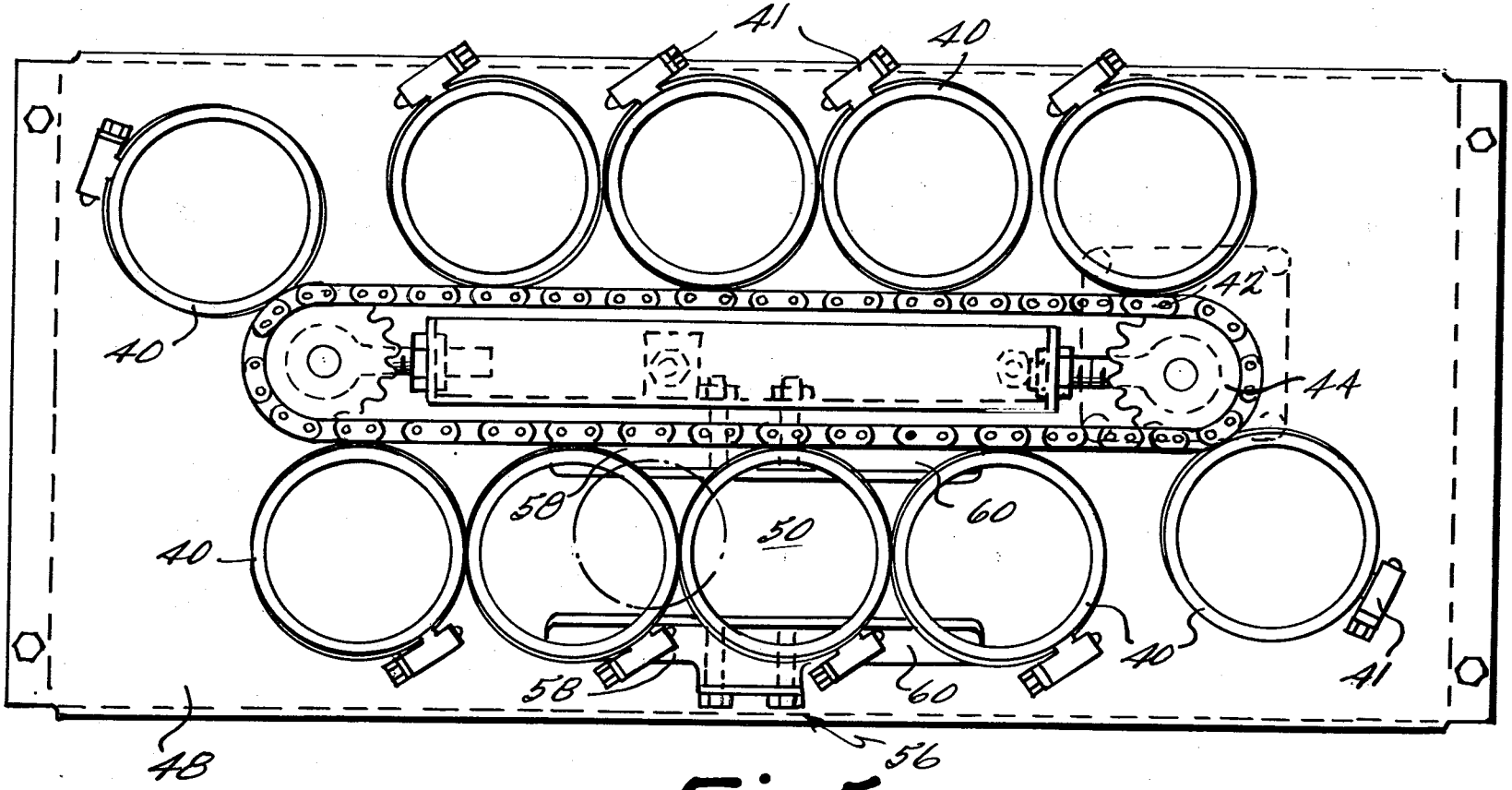
FIG. 5 is a top plan view of exemplary cone dispensing means.
Figure 6:
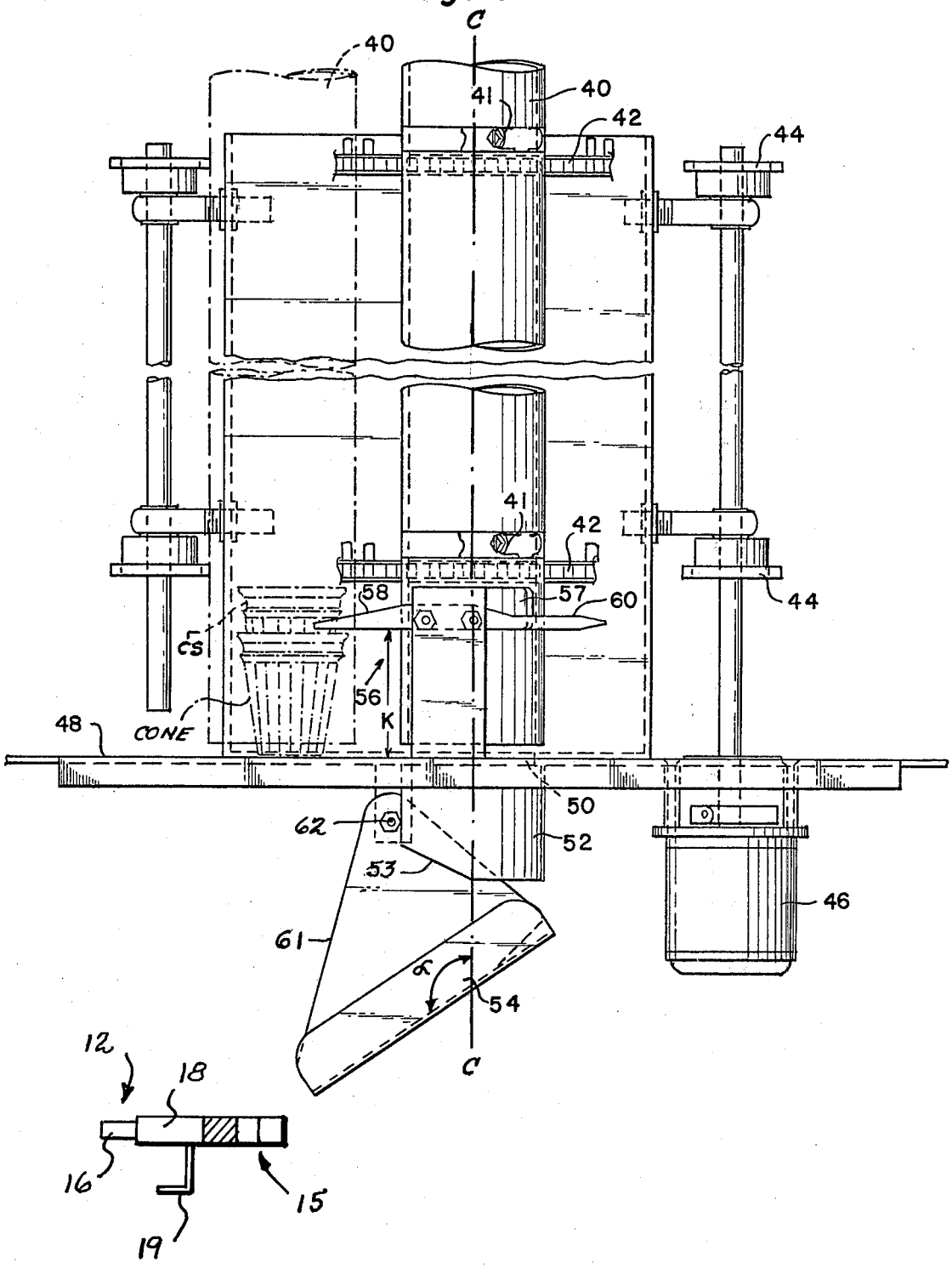
FIG. 6 is a side view, with portions cut away for clarity, of the structure of FIG. 5.

Means for automatically dispensing cones (or other similar containers) at a container discharge station 11, are shown in detail in FIGS. 5, 6 and 7.

A plurality of generally vertically upstanding clear plastic tubes 40 or the like are provided, connected by suitable means such as metallic bands 41 to suitable drive structures such as chains 42 driven by gears 44 and a motor 46. A stack of cones 10 is provided in each one of the tubes 40, and as the tubes 40 are revolved under power of the motor 46, the bottom cone in each stack engages the top of the plate 48 and slides therealong. An opening 50 is provided in the plate 48 in the path of the cylinders 40, with a guide tubular portion 52 extending downwardly from the plate 48 around the opening 50, and a cone guide chute 54 is disposed in operative relationship with the tube portion 52 to guide the path of a cone that drops through the opening 50 and to portion 52 to a product-filling area below the bottom termination of the chute 54. The chute 54 terminates just above arm 12, as shown in FIG. 6.

The cones are dispensed one at a time by the camming means 56. The camming means 56 includes two cam surfaces 58 disposed on either side of the pathway of the tubes 40, each tube 40 having a slit formed therein to allow penetration of the camming surface 58 thereinto. The camming surface 58 is disposed a distance K above the plate 48, the distance K being greater than the height of the container (cone) but being less than—at least at the leading edge thereof—the height of the slanted cam portion CS of the second cone in the stack. The relative movement of the cones in the stack in a tube 40 with respect to the camming surface 58 results in the camming surface 58 engaging the slanting portion 24 of the next-to-the-lowest cone in the stack and raising that cone (and the cones in the stack disposed thereabove) upwardly slightly and supporting it in the vertical direction while the lowest cone in the stack drops through the opening 50 in plate 48, and subsequently is guided by the chute 54 toward the dispensing arm 12. As the tube 40 continues relative movement with respect to the means 56, the formerly next-to-lowest cone in the stack—which is now the lowest cone in the stack—engages the lowering surface 60 (or rather the slanted portion 24 thereof engages the surface 60), to ultimately lower the lowest cone in the stack into engagement with the top of the plate 48. The cones in the next stack in the next tube 40 are simultaneously brought into operative engagement with the means 56 so that automatic one-at-a-time dispensing of the cones is continuous.

When edible cones are used, a sanitary inedible covering may be provided therefor, as shown in commonly-assigned co-pending application Ser. No. 891,316, filed Mar. 29, 1978.

In order to insure that the containers will not be misaligned or inverted during dropping thereof through the opening 50, and will be positively guided into operative association with the arm clamping means 15, the guide means are provided as illustrated in FIGS. 6 and 7 in particular. The guide means includes the generally tubular member 52 and the chute 54 disposed vertically below the tubular member 52, the chute 54 having a generally open top 55 and having a primary container guiding portion 63 thereof extending downwardly from the tubular member 52 and disposed at an obtuse angle with respect to the axis C—C of the tubular member 52 (the axis C—C being generally vertical). The tubular member 52 has angled wall portions 53 thereof formed on the side of the member 52 axis from which the chute 54 extends downwardly at an obtuse angle $\alpha$. The angle $\alpha$—as shown in the drawings is about 124°. The chute container-guiding portion 63—as shown in FIG. 7—is semi-circular in cross-section, having a diameter D slightly greater than the greatest diameter of a container guided thereby. A bracket 61 is operatively connected to the bottom of the plate 48 by a screw and nut arrangement 62 or the like. The means 15 is disposed below the chute 54 as a continuation of the primary container-guiding surface 63 thereof.

Utilizing the cone dispensing structure of FIGS. 5 through 7 it is possible to accurately dispense cones or other similar containers one at a time from stacks to the arm 12 without dropping, misalignment or inversion of the containers during movement from the stacks into operative engagement with the arm 12.

Figure 3:
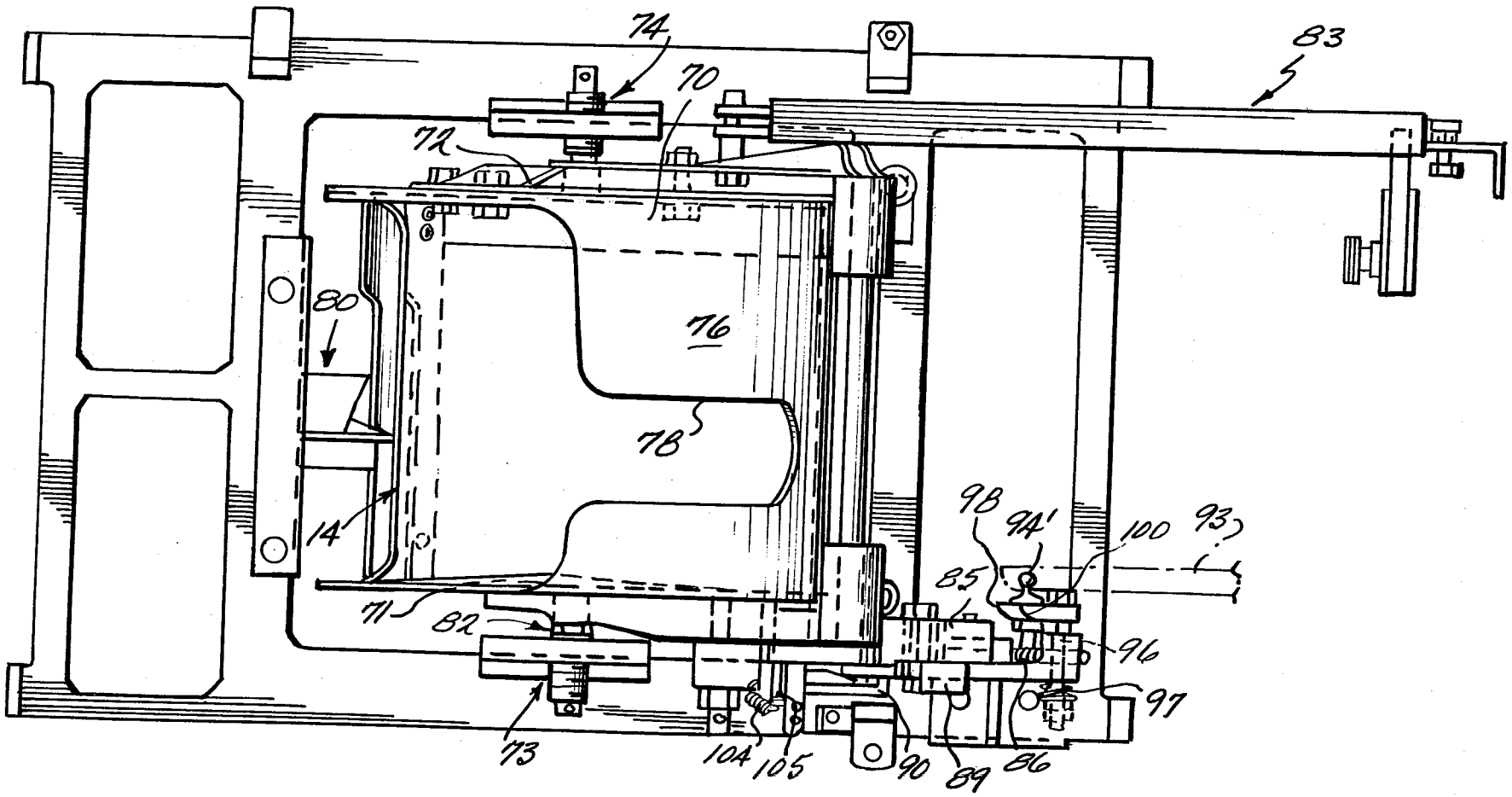
FIG. 3 is a side view of the view of the delivery chamber and latching means of FIG. 2.

The delivery chamber 14 for the machine 10 preferably comprises a cylinder 70 having a bottom disc 71 and a top disc 72. The bottom disc 71 comprises—along with suitable receiving pins such as shown in U.S. Pat. No. 3,413,052—receiving means in the delivery chamber 14 to receive each product filled container being vended after it is released from the container holding means 15. As shown most clearly in FIGS. 2 and 3, means 73, 74 are provided mounted with the disc 71, 72 for effecting adjustment of the vertical position of the cylinder 70. The front face of the cylinder 70 comprises a first door 75, a second door 76 being provided by a second part of the cylinder 70 and rotatable therewith. The first and second doors 75, 76 are alternatively opened and closed, the first door 75 blocking access to the delivery chamber 14 from exterior of the machine 10, and the second door 76 blocking access from the delivery chamber 14 to the arm 12 and the other interior components of the machine 10. A handle 77 is provided on the front face F of the cylinder 70 for effecting rotation thereof, and a slot 78 is formed in the door 76 to allow movement of the arm 12 into the chamber 14 to disposit a product-filled container on the receiving means 71. Abutment means 80 are provided as a ramp for engaging the lever means 16 when the container holding means 15 is within the delivery chamber 14, for moving the lever means 16 against the bias of spring 20 to release the container carried thereby, as more fully described in U.S. Pat. No. 3,413,052. A torsion spring 82 (see FIG. 3) is mounted in operative association with the cylinder 70 to return the cylinder to the position shown in FIG. 2 after release of the handle 77. Preferably, a dash pot 83 is provided for slowing the return movement of the cylinder 70 under the bias of spring 82 so that the consumer will not have his/her hand or fingers injured by the quick return of the cylinder 70.

The torsion spring may be eliminated if desired, and a pneumatic opener and closer may be provided as the element 83. The pneumatic opener and closer allows rapid opening movement of the door 75, but allows only slow closing thereof. Many suitable conventional structures are available for effecting this function.

Mechanical latching means 84 are provided for latching the first door 75 in closed position until the arm item-holding means 15 has been completely withdrawn from the delivery chamber 14 after receipt of an item by delivery chamber 14. The latch means includes a latch member 85 and an over-center spring-biasing means 86 for holding the latch member 85 in either its latched or unlatched position until it is positively moved to the other position. The latch member 85 comprises a door-movement blocking portion 88 and a cam portion 89 disposed in a different plane than the door-movement blocking portion 88. The first door 75 (cylinder 70 axis) includes a blocking member 87 disposed in the same plane as the latch means door-movement blocking portion 88 and adapted to being engaged thereby, and means are provided associated with the first door 75 for resetting the latching means 84 to latch the first door 75 after opening movement thereof and removal of the item from the delivery chamber 14 so that the first door 75 is latched shut during the movement of the arm 12 from into and out of the delivery chamber 14.

The automatic resetting means includes a lever 90 that is movable into engagement with the flat surface of the cam portion 89 to rotate the latch member 85 in the counterclockwise direction about pivot E during closing movement of the first door 75 after opening thereof. The lever 90 is connected by a spring 104 to a pin 105 attached to the bottom of the cylinder 70, so that the lever 90 is moved over-center in response to pivotal movement of the cylinder 70. The mechanism 90 and cam 89 are preferably so positioned that it is necessary that the door 75 be opened more than one-half way before the latch member 85 is tripped back to latching position.

Rod means 92 operatively connected to the arm 12 and latch means 84 are also provided for effecting unlatching of the first door 75 in response to movement of the arm 12 so that the first door 75 is unlatched by the rod means 92 after movement of the arm 12 out of the delivery chamber 14. The rod means 92 includes a rod (which may be adjustable in length) 93 operatively pivotally connected at one end thereof to a ball joint 94 (see FIG. 4) associated with the arm 12, and pivotally connected at the other end thereof to a ball joint 94′ associated with a lever 95. The lever is pivotally mounted for rotation about an axis by a pin 96 at one end thereof, the pin 96 also being movable against a spring bias from spring 97 in a direction generally parallel to the axis about which the lever 95 is pivotal. The lever 95 has cam means (slanted surface portion) 98 formed at the end thereof opposite the pivoted end thereof so that the lever 95 may be cammed over a latch projection 99 with which its cooperates, which latch projection 99 is mounted on the latch member 85. When the lever 95 is pivoted by the rod 93 in the clockwise direction as shown in FIG. 2, the cam means 98 engages the latch projection 99, and the lever is lifted upwardly—against the bias of the spring 97—so that it is cammed out of the way of projection 99 and does not effect any movement of the latch member 85. However, once the lever 95 passes the latch projection 99, by movement of the rod 93 the surface 100 of the lever 95 positively abuts the latch projection 99, and rotates the latch member 85 clockwise about the pivot E as shown in FIG. 2, to thereby effect unlatching of the latch means 84, the portions 87, 88 moving out of interfering relationship with each other.

The latch member 85 further comprises cam surface means 108 (see FIGS. 2 and 9) for engaging an actuator 110 for a microswitch 109, the movement of the latch member 85 to the latching position effecting operation of the microswitch 109 to thereby energize the steping motor 46 which drives the gears 44 and chains 42 to move the next tube 40 into operative association with the opening 50, so that the next container is dropped into operative association with the arm 12. Switch means 109—as shown in FIG. 9—also may effect closing of a switch connecting motor 34 to power, so that motor 34 is not capable of energization unless the first door 75 has been relatched after opening and then closing thereof. A stop 111 may also be associated with the cam means 108 for providing a positive stop for the latch member 85 in its latching and unlatching positions, the positive stop 111 preventing damage to the over-center spring means 86.

Operation of an exemplary structure according to the invention will now be described, with particular reference to FIGS. 8 through 10 which show schematics illustrating operation thereof. Operation of the machine 10 starts with the arm 12 at the container discharge position 11, with a cone or other container received by the clamping end 15 of the arm 12. A consumer placing a coin in the coin slot activates a coin responsive switching system 124, which in turn energizes the motor 34 to rotate the plate 34′ (see FIG. 10) 90° to bring the arm 12 into position below the dispensing nozzle at the product dispensing station 13. The photo-electric assembly 115 (see FIG. 8) senses the movement of the arm 12 into a position underneath the dispensing head, which causes the relay 116 to be deactivated, closing switch 117 and therefore completing a circuit which effects energization of the dispensing head. Product is dispensed by the dispensing head until the predetermined weight of product desired has been dispensed, which is sensed by the switch means 24, and which may be adjusted by adjusting the tension on the springs 23, 26 and the position of the operator 25. When switch means 24 is actuated, the supply of power to the dispensing head is cut off and no more product is dispensed, and simultaneously the switch 119 is closed momentarily, the circuitry 120 maintaining the supply of electrical energy to the motor 34 once the momentary completion switch 119 is closed so that the plate 34' drives the arm 33 from the station 13 to the delivery chamber 14, and then back to the original position 11 wherein the arm is out of the delivery chamber 14 and in operative association with the container dispensing means station 11. A cam 122 may be provided associated with the plate 34' for actuating the switch 121 of the circuit means 120 to terminate energization of the motor 34 once the plate 34' has returned to its original position (see FIG. 10).

Movement of the arm 12 out of the delivery chamber 14 effects movement of the lever 95 into abutting engagement with the latch 99, which pivots the latch member 85 clockwise at about the pivot E (see FIG. 2) to provide unlatching of the first door 75. Since the first door 75 is unlatched, the consumer may now grasp the handle 77, and rotate the door 75 clockwise (as shown in FIG. 2) so that access to the delivery chamber 14 is provided, the second door 76 blocking entry from the delivery chamber 14 to the interior of the machine 10, such as access to the arm 12. After the consumer releases the handle 77, it moves under the bias of torsion spring 82 back to its original position (FIG. 2) wherein the door 75 is closed, the dash pot 83 slowing the return movement. During the return movement, the lever 90 is moved into operative association with the cam portion 89 of the latch member 85, so that the latch 85 is rotated counterclockwise about the pivot E, (see FIG. 2) back into latching engagement with the first door 75.

During movement of the arm 12 into the delivery chamber 14, the abutment means 80 pivots the lever 16 against the bias of spring 20 to release the product-filled container so that it is deposited on the disc 71. The rotation of the latch member 85 back to the latching position effects movement of the cam surface 108 (see FIG. 9 in particular) to actuate the plunger 110 to operate the switch means 109, which is connected by the circuitry 112 to the stepping motor 46, which then rotates the next tube 40 into position above the opening 50 so that the next cone drops down through the chute 54 into clamping engagement by the arm 12. The procedure may then be repeated by deposit of another coin into the coin receiving slot.

It will thus be seen that according to the present invention an automatic vending machine has been provided which automatically delivers containers having edible product therein, such as cones filled with soft ice cream. While the invention has been herein shown and described in what is presently conceived to be the most preferred and practical embodiment thereof, it will be apparent to those of ordinary skill in the art that many modifications may be made thereof within the scope of the invention, which scope is to be accorded the broadest interpretation of the apended claims so as to encompass all equivalent structures and devices.

What is claimed:

1. An automatic vending machine for delivering stackable containers having edible product therein comprising a container discharge station for discharging empty containers one at a time into operative association with an arm pivotally mounted to the machine for rotation about a first, generally vertical axis; said arm having an end thereof having container-holding means for receiving and holding containers adapted to have edible product delivered thereto and to be vended and including releasable clamping means including lever means movable between a first and second position for releasing said clamping means; said clamping means being dimensioned to receive an empty container from a position above said clamping means and to hold the container in place; a container filling station for filling a container held by said container-holding means with edible product; and a delivery chamber for receipt of containers having edible product therein; and release means for acting upon said lever means for releasing said clamping means when said arm moves into said delivery chamber; said container discharge station comprising at least one stack of containers disposed in a position above said arm, and means for effecting dropping of containers one at a time from said stack to said arm including a generally horizontal plate having an opening formed therein greater than the largest diameter of a container to be passed therethrough; guide means located vertically between said at least one container stack and said arm for guiding dropping of containers into operative association with said arm clamping means so that said containers will not be misaligned or inverted during dropping and will be positively guided into operative association with said arm clamping means; said guide means including a generally tubular member disposed below said at least one container stack and having one end thereof directly vertically below said at least one container stack, and having a chute disposed vertically below the other end of said generally tubular member, said chute having a generally open top and having a primary container-guiding portion thereof extending downwardly from said tubular member and disposed at an obtuse angle with respect to the vertical; wherein the improvement comprises:

a planar, vertical bracket integral with said chute over substantially the length thereof, said chute being semi-circular in shape; and means for operatively releasable attaching said bracket to and beneath said generally horizontal plate of said container discharge station, said attaching means being horizontally displaced from, and distinct from, said tubular member of said guide means, and mounting said chute so that it is vertically displaced from said tubular member over the entire length thereof.

2. A machine as recited in claim 1 wherein said container discharge station further comprises a plurality of generally vertically upstanding tubes located above said plate, each tube adapted to receive a stack of containers therein, means for connecting each of said tubes to a drive structure for revolving said tubes so that each, in turn, is disposed vertically above said plate opening, and camming means located above said plate a distance greater than the height of a container, for engaging cam portions of the second container of a stack of containers within a tube for supporting the second container and all containers thereabove in the stack while allowing the first container to fall through said plate opening when said tube comes into true cooperating relationship with said opening.

3. A machine as recited in claim 2 wherein said delivery chamber comprises a first door for preventing access to said delivery chamber from exterior of said machine, and further comprising latch means for latching said first door shut until said arm has deposited a container filled with product into said delivery chamber and has been completely withdrawn from said delivery chamber and for unlatching said door after said arm has been completely withdrawn from said delivery chamber; a microswitch; cam means associated with said latch means for operatively actuating said microswitch upon unlatching of said first door; and circuitry means connecting said microswitch to said tubes drive for moving the next of said plurality of vertically upstanding tubes into operative association with said plate opening.

* * * * *